US006089466A

United States Patent [19]

Fulton et al.

[11] Patent Number: 6,089,466

[45] Date of Patent: Jul. 18, 2000

[54] ROADBED FOR MODEL RAILROADS

[75] Inventors: C. Dwayne Fulton; David L. Osment, both of Osage Beach, Mo.

[73] Assignee: Osment Models, Inc., Linn Creek, Mo.

[21] Appl. No.: 09/129,659

[22] Filed: Aug. 5, 1998

[51] Int. Cl.[7] ..... E01B 23/00

[52] U.S. Cl. ..... 238/10 B; 238/10 R; 238/10 E

[58] Field of Search ..... 238/2, 10 R, 11, 238/12, 10 A, 10 B, 10 C, 10 E, 10 F

[56] References Cited

U.S. PATENT DOCUMENTS

| | | | |
|---|---|---|---|
| 2,028,401 | 1/1936 | Lore | 238/10 B |
| 2,153,624 | 4/1939 | Jones | 238/10 B |
| 2,188,894 | 1/1940 | Tyler | 238/10 B |
| 2,562,623 | 7/1951 | Levering | 238/10 B |
| 2,665,848 | 1/1954 | Smith et al. | 238/10 B |
| 3,650,468 | 3/1972 | Ewe et al. | 238/10 E |
| 4,849,269 | 7/1989 | Grace | 428/81 |
| 5,271,499 | 12/1993 | Van Horssen | 206/335 |
| 5,326,267 | 7/1994 | Brokaw | 434/151 |

*Primary Examiner*—Mark T. Le
*Attorney, Agent, or Firm*—Shook, Hardy & Bacon LLP

[57] ABSTRACT

A structure is provided for creating a roadbed for a model railroad. The structure includes an elongated and flexible section which has a top surface, a bottom surface and a pair of inwardly angled side surfaces. The side surfaces are angled such that the bottom surface is wider that the top surface. The section is made from a foam material which deadens the sound of model trains passing thereover and which cushions vibrations of model trains passing thereover. The top surface is a closed cell surface that allows model train track to be adhesively secured thereto and the bottom surface is a closed cell surface that allows the roadbed to be adhesively secured to a supporting surface.

10 Claims, 1 Drawing Sheet

ROADBED FOR MODEL RAILROADS

STATEMENT REGARDING FEDERALLY SPONSORED RESEARCH OR DEVELOPMENT

Not Applicable.

CROSS REFERENCE TO RELATED APPLICATIONS

Not Applicable.

BACKGROUND OF THE INVENTION

The present invention relates to a novel structure for constructing a model roadbed for use in model railroading. More particularly, the invention is directed to a structure which can be used to form a model roadbed that allows for a quieter and smoother operation of a model train, and that can be installed without the use of nails.

Railroading enthusiasts and hobbyists of all ages have long enjoyed the challenge of model railroading. One of the challenges faced by these hobbyists is constructing a realistic layout that accurately simulates an actual landscape. The layout will include a pattern for the track on which the train will travel. This pattern may involve elevational changes for the track, to simulate grades, bridges and tunnels. After the layout is designed, it must then be constructed.

In general, railroad transportation involves a locomotive that pulls the rolling stock, which may include passenger cars and freight cars. The locomotive and the rolling stock are supported and travel along a track that is in turn supported by a roadbed. The roadbed is supported upon a subroadbed structure. Thus, in constructing a model railroad layout it is necessary to construct the subroadbed upon which the track is placed. The subroadbed that is constructed must conform to the grades in the layout, and support the track and roadbed that are placed thereon.

After the subroadbed is constructed, a roadbed is typically installed thereon. The roadbed is used to support a model train track, which is secured to the roadbed. After the model track is installed on the roadbed, a ballast material is placed over the track and roadbed. This ballast is typically an aggregate material and is usually installed with an adhesive.

Prior art model roadbeds suffer from a number of disadvantages. First, most prior art roadbeds are constructed from a cork material. This cork material is supplied in a rectangular configuration with a slanted notch cut down the middle thereof. Before the cork roadbed is installed, it must be separated into two strips, divided by the slanted notch. The two original outside edges are then placed toward the middle, so that the roadbed has a pair of slanted side surfaces when it is installed. The cork material must, therefore, be separated and reoriented prior to its installation. The cork roadbeds are thus shipped in rectangular form to protect the angled or slanted edges from crumbling and otherwise becoming damaged. Further, the cork roadbed material dries out over time and can crumble as it ages.

Another disadvantage of prior art roadbeds, and cork roadbeds in particular, is their lack of sound deadening properties. When a cork roadbed is installed, and a track is placed thereon, a model train passing over the track will generate a certain level of noise. It is generally desirable to minimize this noise to as low a level as possible. However, the cork roadbed does not absorb or deaden sound to the degree desired by the typical model railroader.

Prior art roadbeds are also relatively rigid, such as those made from fiber board, wood or cork. These rigid materials do not offer as much cushioning from vibration as is desired by the model railroader. The vibration may also cause the track to move relative to the roadbed, which requires monitoring and maintenance. Further, the vibrations add to the noise caused by the train traveling upon the track, which is disadvantageous as discussed above. Finally, the vibration may cause a train traveling upon the track to derail. Derailments are undesired as they must be tended to and may cause damage to the surrounding layout. Elimination or reduction of vibration will therefore allow the model train to more smoothly travel upon the track.

The relative rigidity of prior art roadbed also does not accommodate irregular support surfaces for the roadbed. Therefore, particular attention must be paid to the subroadbed, or support surface, to ensure that it is as flat as possible to ensure that the roadbed, and the track, can effectively be attached thereto.

The model layout that is designed will almost always have sections which contain a curved track. Therefore, the roadbed that is used must be able to curve to conform to the curves in the layout. When a cork roadbed is used, and the roadbed needs to be curved, the roadbed is first soaked in water. It is necessary to soak the cork roadbed in water to allow the roadbed to conform to the desired curve without cracking or crumbling. This process adds to the time needed to build a layout, and also requires additional attention to ensure that water does not come in contact with any surfaces which may be damaged by moisture.

Other prior art roadbed materials which are used are also problematic when forming a curved section of roadbed. For example, when a wooden roadbed is used, a curved section can be formed only by purchasing and using a preset curve of a preset radius. This limits the model railroader in the layout that can be constructed. Another prior art roadbed is made from a rigid, fiber-board material, sold under the tradename HOMOSOTE. When forming a curved section of roadbed using this fiber-board material, the roadbed must be formed by using discrete segments. This adds to the time and difficulty necessary to create the roadbed.

Therefore, a structure is needed that can be used to quickly and easily create a relatively lightweight roadbed on a model train layout that deadens the sound of a model train passing thereover and that absorbs the vibrations from a model train passing thereover. Further, a roadbed is need that can be curved without soaking the roadbed in water. Still further, a roadbed is needed that is made from a material that allows the roadbed to be shipped in a shape and form useable by the model railroader without further manipulation.

SUMMARY OF THE INVENTION

It is an object of the present invention to provide a roadbed that can be used on a model train layout that deadens the sound of a model train passing thereover.

It is a further object of this invention to provide a roadbed that can be used on a model train layout that absorbs the vibrations caused by a model train passing thereover.

It is yet another object of this invention to provide a roadbed that can be installed in a curved configuration without the need to soak the roadbed prior to installation.

It is another object of this invention to provide a roadbed that can be manufactured and shipped in a form useable by a model railroader without first separating and reorienting the roadbed.

According to the present invention, the foregoing and other objects are obtained by a structure for creating a roadbed for a model railroad. The structure includes an elongated and flexible section which has a top surface, a bottom surface and a pair of inwardly angled side surfaces. The side surfaces are angled such that the bottom surface is wider than the top surface. The section is made from a foam material which deadens the sound of model trains passing thereover and which cushions vibrations of model trains passing thereover. The top surface is a closed cell surface that allows model train track to be adhesively secured thereto and the bottom surface is a closed cell surface that allows the roadbed to be adhesively secured to a supporting surface.

Additional objects, advantages, and novel features of the invention will be set forth in part in the description which follows, and in part will become apparent to those skilled in the practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

In the accompanying drawings which form a part of the specification and which are to be read in conjunction therewith and in which like reference numerals are used to indicate like parts in the various views.

DETAILED DESCRIPTION OF THE INVENTION

Figure 1:
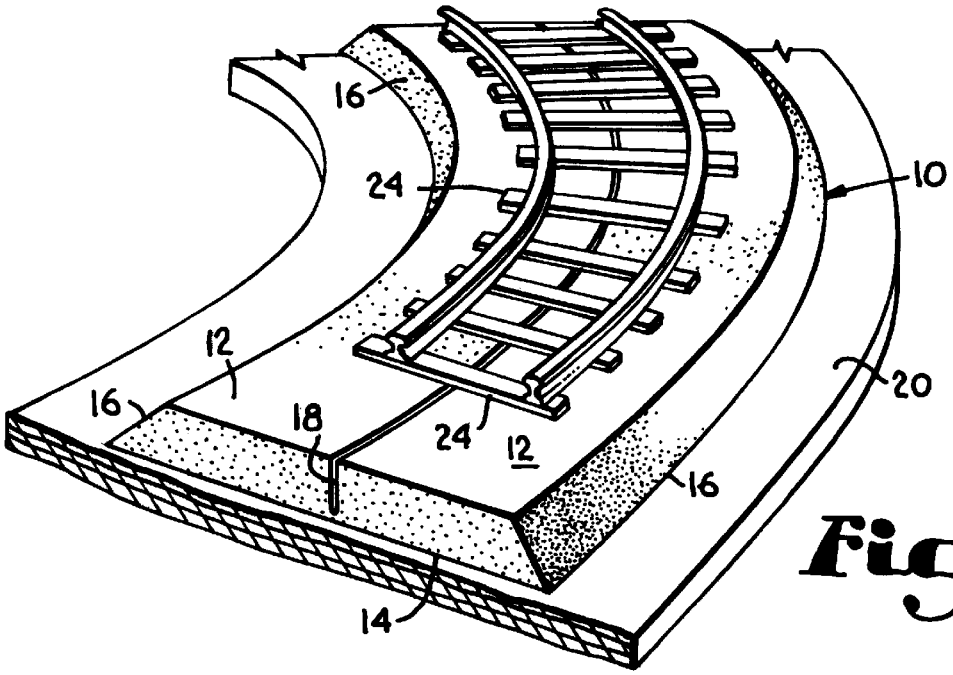
FIG. 1 is a perspective view of a section of roadbed in place on a supporting surface according to the present invention, with a track placed thereon and shown in a radiused orientation.
Figure 3:
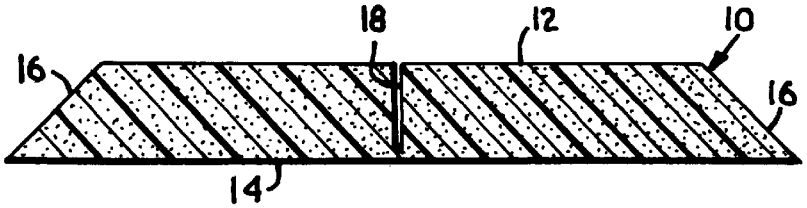
FIG. 3 is cross-sectional view taken along line 3–3 of FIG. 2.

A model train roadbed section embodying the principles of this invention is broadly designated in the drawings by reference numeral 10. As best seen in FIGS. 1 and 3, roadbed section 10 has a top 12 and a bottom 14. Between top 12 and bottom 14 are a pair of slanted side surfaces 16. Side surfaces 16 are angled such that top 12 is narrower than bottom 14. Roadbed 10 has an optional longitudinal slit 18 therein that extends from top 12 towards bottom 14.

Figure 2:
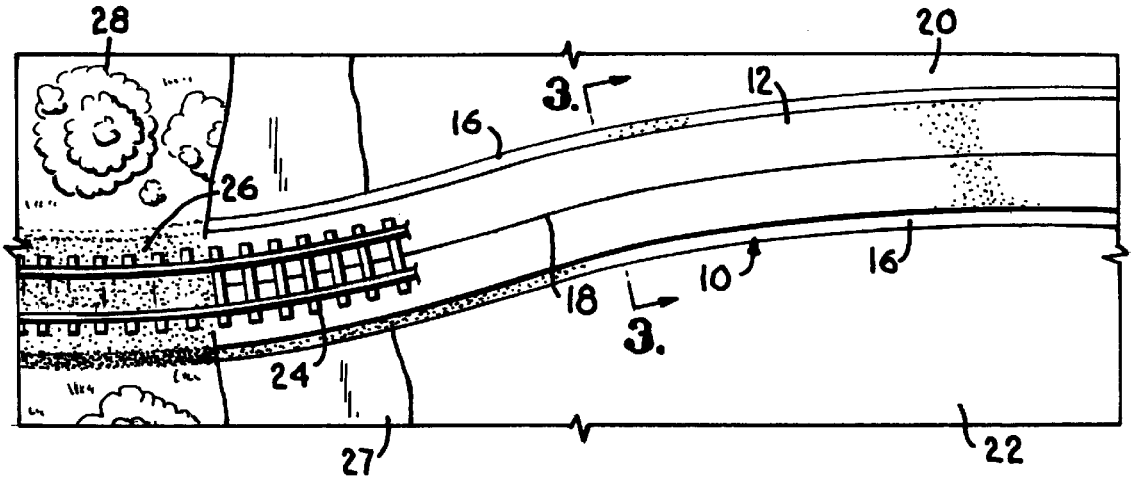
FIG. 2 is a top elevation view of the roadbed of FIG. 1, shown with additional landscaping added.

In use, a support surface 20, also known as subroadbed, is placed upon a base 22. Typically, base 22 is made from a sturdy material, such as plywood. After support 20 is coupled to base 22, roadbed 10 is placed on support 20 and is coupled thereto with an adhesive material, or through the use of tacks. Roadbed 10 is made from a closed cell foam material, preferably polyethylene foam, that is flexible so that a variety of curved configurations are possible, according to the layout that has been designed and as seen in FIGS. 1 and 2. The preferred foam material will have a density of between one and four pounds per cubic foot. Also, the preferred foam material will have a skin on top 12 and bottom 14, but an open cell structure on side surfaces 16. The skin on top 12 is referred to as a closed cell structure. By open cell structure, it is meant that the cells of the foam material are exposed, and can be seen. Because roadbed 10 is made from a flexible foam material, it is not necessary to first soak roadbed 10 in water prior to installing it in a curved configuration. Thus, the flexibility of roadbed 10 thus allows it to more easily be placed in a curved configuration, especially as compared to the pior art materials of cork, wood and fiber board. For tighter or more severe curves, it may be necessary to install roadbed 10 in two sections. Optional slit 18 easily allows roadbed 10 to be divided into two longitudinal sections, which may be more easily manipulated for tight curves.

It is not necessary to first divide roadbed 10 into two sections for straight sections and for curves with a lesser radius. Further, because roadbed 10 is made from a flexible foam material, it may be manufactured and shipped in a ready to use form. In other words, roadbed 10 may be manufactured and shipped with angled side surfaces 16 on the outside edges, without the risk of side surfaces 16 becoming damaged during shipping and handling.

After roadbed 10 is in place, a track 24 is attached to top 12, preferably with an adhesive. The model train will be carried upon track 24. After the track is secured in place with an adhesive, the track may be further secured in place with a series of tacks, as is known in the art. The tacks used will be placed through track 24, through roadbed 10 and into support surface 20. It should be understood, however, that the use of tacks or nails is not necessary using the roadbed of the present invention. Following installation of track 24, a ballast material 26 is adhesively coupled to roadbed 10, as seen in FIG. 2. Ballast 26 is typically an aggregate material to simulate actual ballast used in real railroads. Prior to installation of track 24, it may be desireable to install a plaster cloth material 27 over support surface 20. The plaster cloth material can be sanded and painted to simulate an actual landscape. Thereafter, various landscaping materials 28 can be installed to add realism to the layout.

As stated above, roadbed 10 is made from a foam material. The foam material is preferably black in color and is constructed so that the foam cell has a closed cell profile on top 12 and bottom 14. Side surfaces 16 have an open cell profile. This construction of roadbed 10 allows the roadbed to be adhesively secured to support 20. The closed cell structure of bottom 14 provides a relatively smooth surface for contacting support 20, and prevents the adhesive from being drawn upwardly into the roadbed. Further, the closed cell structure of top 12 provides a relatively smooth surface on which to place and attach track 24. Therefore, a model train carried by track 24 will have a relatively smooth track on which to travel.

The open cell profile of side surfaces 16 provides a more realistic appearance than is provided by the prior art roadbeds, particularly those made of cork. The black, open cell appearance of side surfaces 16 particularly provides a more realistic appearance in those areas of roadbed 10 that are not completely covered by ballast material 26. Further, the open cell structure of side surfaces 16 provides a somewhat uneven surface on which ballast 26 will be placed. This more uneven surface further adds to the realism provided by roadbed 10.

The flexible foam material of roadbed 10 also provides a roadbed that offers increased sound deadening properties over those offer by prior art cork roadbeds. Roadbed 10 can thus be used to create a layout offering quieter operation, as is desired by many model railroaders.

The flexible roadbed 10 can also conform to any irregularities which may be present on support 20, enabling top surface 12 to be even and smooth despite slight irregularities in support 20. As stated above, it may be desireable to cover surface 20 with a plaster cloth material 27. This cloth material may contain surface irregularities, such as small bumps. Even if the plaster cloth material is not sanded to be flat, the resilient nature of roadbed 10 will allow top surface 12 to be smooth, despit the irregularities. The resilient nature of roadbed 10 can also accomodate a support 20 that is not perfectly parallel to the track 24. Both track 24 and support 20 are relatively rigid structures. In areas of the layout where track 24 and support 20 are not parallel and evenly spaced from one another, the resilient and flexible nature of roadbed 10 will allow the space between track 24 and support 20 to be effectivey filled. Moreover, the roadbed 10 will act to completely fill the space between track 24 and support 20. Prior art materials, being more rigid, cannot act to effectivley fill the space between track 24 and support 20 in areas where the two are not evenly spaced and parallel to one another.

Further, the foam material of roadbed 10 acts to cushion vibrations caused by model trains traveling along track 24. Roadbed 10 thus reduces unwanted vibrations that may cause track 24 to move relative to the roadbed. As vibrations are reduced, the noise caused by the train traveling upon track 24 is further reduced. Finally, as vibration is reduced, the likelihood that a model train traveling upon track 24 will derail is reduced. Roadbed 10 therefore allows a model train to more smoothly travel upon track 24.

From the foregoing, it will be seen that this invention is one well adapted to attain all the ends and objects hereinabove set forth together with other advantages which are obvious and which are inherent to the structure. It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, what is claimed is:

1. Structure for creating a roadbed for a model railroad, said structure comprising:

an elongated and flexible roadbed section having a top surface, a bottom surface and a pair of inwardly angled side surfaces, such that said bottom surface is wider than said top surface, wherein said section is made from a foam material which deadens the sound of model trains passing thereover and which cushions vibrations of model trains passing thereover, and wherein said top surface is a generally flat closed cell surface that allows a model train track to be positioned thereon and secured thereto, said side surfaces have an open cell surface, and wherein said bottom surface is a closed cell surface that allows said section to be secured to a supporting surface.

2. The structure of claim 1, wherein said section has a slit extending from said top surface towards said bottom surface, said slit allowing said section to be divided into two longitudinal sections.

3. The structure of claim 2, wherein said slit is located equal-distant between said side surfaces.

4. The structure of claim 3, wherein said section has a width and wherein said width can vary to accommodate a variety of scales of model train track.

5. The structure of claim 4, wherein said foam material is flexible and can be placed in a curved configuration without first soaking said material in a liquid.

6. A roadbed for use in model railroading, comprising:

an elongated section having a top surface, a bottom surface and a pair of inwardly angled side surfaces, such that said top surface is narrower than said bottom surface, said section being made from a flexible, high-density foam material with an open-cell structure on said side surfaces to create a realistic appearance.

7. The roadbed of claim 6, wherein said foam material deadens the sound of model trains passing thereover and cushions vibrations from model trains passing thereover.

8. The roadbed of claim 7, wherein said top and bottom surfaces are closed-cell surfaces so that said bottom surface can be adhesively secured to a support surface and a model train track can be adhesively secured to said top surface.

9. The roadbed of claim 8, wherein said roadbed has a slit extending from said top surface substantially to said bottom surface, said slit allowing said roadbed to be divided into two longitudinal sections.

10. The roadbed of claim 9, wherein said roadbed may be manipulated into a curved configuration.

* * * * *